US006445901B1

(12) United States Patent
Rasch et al.

(10) Patent No.: US 6,445,901 B1
(45) Date of Patent: Sep. 3, 2002

(54) FUSER RELEASE AGENT MANAGEMENT SYSTEM WITH DRIVEN SUPPLY REEL

(76) Inventors: Kenneth R. Rasch, 43 County Clare Crescent, Fairport, NY (US) 14450; Barry J. Gheer, 154 Peart Ave., Rochester, NY (US) 14622; Tab A. Tress, 10 Pacer Dr., Henrietta, NY (US) 14467; Richard A. Geyer, 184 Bittersweet Dr., Farmington, NY (US) 14425

( * ) Notice: Subject to any disclaimer, the term of this patent is extended or adjusted under 35 U.S.C. 154(b) by 0 days.

(21) Appl. No.: 09/767,966

(22) Filed: Jan. 23, 2001

(51) Int. Cl.[7] ..... G03G 15/20
(52) U.S. Cl. ..... 399/325
(58) Field of Search ..... 399/324, 325; 118/60

(56) References Cited

U.S. PATENT DOCUMENTS 5,049,944 A * 9/1991 DeBolt et al. ..... 399/325
5,420,678 A * 5/1995 Rasch et al. ..... 399/324
6,006,063 A * 12/1999 Shimizu et al. ..... 399/325
6,070,044 A * 5/2000 Hoffmann et al. ..... 399/325

* cited by examiner

*Primary Examiner*—William J. Royer
(74) *Attorney, Agent, or Firm*—Perman & Green, LLP

(57) ABSTRACT

Apparatus for applying a release agent to a fuser roll is constructed having a web material impregnated with the release agent. A supply reel is rotatably mounted in a housing and contains a roll of web material for dispensing into the system. The web material is extended across the fuser roll to a take-up reel. An application roller is positioned adjacent to the fuser roll on the opposite side of the web path and is biased against the web material to provide a force to insure engagement between the web and the fuser roll. The supply reel is driven to dispense the web material in a direction consistent with the tangential direction of the surface of the fuser roll.

8 Claims, 3 Drawing Sheets

FUSER RELEASE AGENT MANAGEMENT SYSTEM WITH DRIVEN SUPPLY REEL

FIELD OF THE INVENTION

This invention relates to fuser apparatus for electrostatographic reproduction machines and in particular to a fusing oil supply roll assembly having a fuser release agent management system.

BACKGROUND OF THE INVENTION

In the process of xerography, a light image of an original document to be reproduced is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic, as well as the electrographic recording arts, the use of thermal energy and pressure for fixing toner images onto a support member is old and well known.

One approach to heat and pressure fusing of electroscopic toner images onto a support has been to pass the print medium, with the toner images thereon, between a pair of opposed fusing rolls or roller members, at least one of which is internally heated. The opposed fusing rollers each have a length sufficient to handle different cross-track dimensions of print medium or copy sheets. During operation of a fusing system of this type, a copy sheet to which the toner images are electrostatically adhered is moved through the nip formed between the fusing rolls with the toner image contacting the heated or fuser roll of the pair, thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above a "hot offset" temperature of the toner. Ordinarily, at such a hot offset temperature, the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as that of the hot fuser roll.

Occasionally, however, toner particles will offset to the fuser roll due to an insufficient application of heat to the surface of the fuser roll (referred to as, "cold" offsetting). It may also offset due to imperfections in the properties of the surface of the roll; or due to the toner particles insufficiently adhering electrostatically to the copy sheet. In any such case, toner particles transferred to the surface of the hot fuser roll are undesirable, and likely to be transferred subsequently to the backup roll during periods of time when no copy paper is in the nip.

In addition, toner particles can be undesirably picked up by the fuser and/or backup rolls during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possess a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A system of this type is described in U.S. Pat. No. 5,576,821, which was issued in 1996 to Xerox Corporation, the owner of the subject application. The disclosure of the '821 patent is incorporated herein by reference. In the '821 patent a release agent supply system consists of a roll of web material stretched between a supply roller and a take-up roller and having an application and oil supply roller positioned in between. The application and oil supply roller is positioned adjacent to the fuser roll and forms a nip therewith through which the web material passes. The web is impregnated with a release agent oil and supplemental oil is supplied on a continuing basis by the supply roller. The release agent oil is applied to the fuser roll as the web passes through the nip. The web moves through the nip by driving the take-up roller. The system of this patent is designed to apply the release agent as well as cleaning the fuser roll. To accomplish this the web material is moved across surface of the fuser roll in a direction which is opposite to the movement of the fuser roll.

In order to properly monitor the supply of web material and predict depletion, the web must be fed through the nip at a consistent speed. To accomplish this, the take-up roller drive motor is controlled by an algorithm which compensates for the changing overall diameter of the take-up roller. Premature exhaustion of the web material may occur because of an error between the actual diameter of the take-up roller and its calculated theoretical diameter, upon which the algorithm relies. These errors are caused by stretching, wrinkling, or contamination of the web material as it winds onto the take-up roller. It is a purpose of this invention to reduce the inaccuracies caused by errors in the actual diameter of the take-up roller and its calculated theoretical diameter.

SUMMARY OF THE INVENTION

To accomplish the purpose of this invention a release agent supply system is constructed adjacent to a fuser roll of an electrostatic printing machine. The release agent is supplied by a web material which is impregnated with an oil which constitutes the release agent. The web material is drawn over the fuser roll and engages the surface thereof to transfer oil from the impregnated web to the fuser roll. The web material is formed as a roll on a cylindrical reel which is mounted for rotation in advance of the fuser roll. The web material is stretched over the fuser roll to a take-up reel positioned on the opposite side of the fuser roll. In accordance with this invention an application roller is positioned between the supply reel and the take-up reel and is spring biased against the fuser roll to form a nip through which the impregnated web material extends. To improve accuracy in the relative movement of the fuser roll and the web material, the supply reel is driven. Since this reel is of a more predictable diameter, the accuracy of the release agent application process is improved. A consistent speed of the web material is obtained through the algorithm controlled drive motor and this results in more reliable monitoring. The take-up reel is also driven at a speed sufficient to maintain tension on the web material while avoiding stress that might cause damage.

DESCRIPTION OF THE DRAWINGS

The present invention will now be described by way of example with reference to the accompanying drawings, wherein like reference numerals refer to like elements, and in which.

DESCRIPTION OF THE PREFERRED EMBODIMENT

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
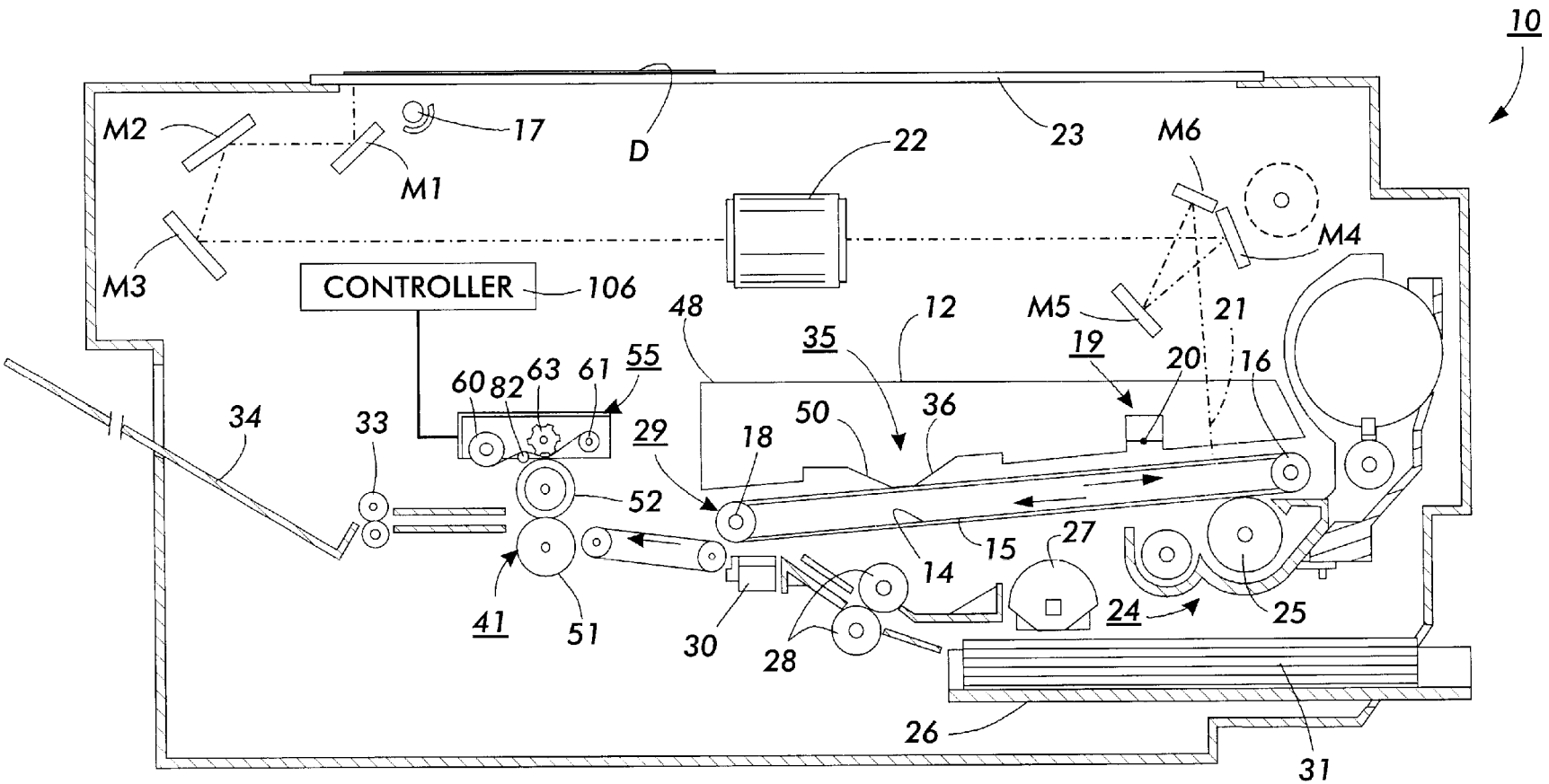
FIG. 3 is a schematic representation, in cross-section, of an automatic electrostatographic reproduction machine incorporating the fuser apparatus of FIG. 1.

Referring first to FIG. 3, there is shown by way of example, an automatic electrostatographic reproducing machine 10 which includes a release agent management system 55. The reproducing machine depicted in FIG. 3 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including electrostatographic reproduction systems and is not necessarily limited in application to the particular embodiment or embodiment shown herein.

The reproducing machine 10 illustrated in FIG. 3 employs a removable processing cartridge 12 which may be inserted and withdrawn from the main machine frame. Cartridge 12 includes an image recording belt like member 14 the outer periphery of which is coated with a suitable photoconductive material forming an image bearing surface 15. The belt is suitably mounted for movement within the cartridge about driven transport roll 16, around idler roll 18 and travels in the direction indicated by the arrows on the inner run of the belt to bring the image bearing surface 15 past a plurality of xerographic processing stations. Suitable drive means such as a motor, not shown, are provided to power and coordinate the motion of the various cooperating machine components whereby a faithful reproduction of an original input image is recorded on the surface 15 and then transferred to a sheet of final support material 31, such as paper or the like.

Initially, the belt 14 moves the image bearing or photoconductive surface 15 through a charging station 19 where the belt is uniformly charged with an electrostatic charge placed on the photoconductive surface by charge corotron 20 in a known manner, preparatory to imaging. Thereafter, the belt 14 is driven to exposure station 21, where the charged photoconductive surface 15 is exposed to a light image of an original document. The charge is selectively dissipated in the light exposed regions to record the original input image in the form of an electrostatic latent image on the surface 15.

The optical arrangement creating the latent image comprises a scanning optical system with lamp 17 and mirrors $M_1$, $M_2$, $M_3$ mounted to a scanning carriage (not shown) to scan an original document D on an imaging platen 23, lens 22 and mirrors $M_4$, $M_5$, $M_6$, to transmit the image to the photoconductive surface 15 in a well known manner. The speed of the scanning carriage and the speed of the image recording belt are synchronized to provide faithful reproduction of the original document.

After exposure of belt 14 the electrostatic latent image recorded on the photoconductive surface 15 is transported to development station 24, where developer is applied to the photoconductive surface 15 of the belt 14 rendering the latent image visible. The development station includes a magnetic brush development system including developer roll 25 utilizing a magnetic developer mix having course magnetic carrier granules and fusable toner colorant particles.

Copy sheets or other print medium 31 are contained in a stack arranged on elevated support tray 26 in a desired orientation. With the stack at its elevated position, a sheet separator segmented feed roll 27 feeds individual sheets therefrom in the desired orientation, for example, short edge first, to a registration pinch roll pair 28. A sheet, fed short edge first, thus, is moved through a sheet path or track within the machine such that its short edge dimension is the "cross-track" dimension of the sheet being fed. The sheet 31 is then forwarded thus to the transfer station 29 in proper registration with the image on the belt 14 and the developed or toner image on the photoconductive surface 15 is brought into transfer contact with the sheet 31 within the transfer station 29. There the toner image is transferred from the photoconductive surface 15 to the contacting side of the final support sheet 31 with the aid of a transfer corotron 30.

Following transfer of the image, the final sheet 31 is separated from the surface 15 as it passes around the idler roll 18, and is advanced to the fuser apparatus 41 of the present invention wherein a pressure roll 51 and a heated fuser roll 52 fuse and fix the transferred toner image onto the sheet 31. After fusing the toner image to the copy sheet 31, the sheet is then advanced by output rolls 33 to a sheet output tray 34.

Although a preponderance of toner powder is transferred to the sheet or final support material 31, invariably some residual toner remains on the photoconductive surface 15 after such transfer. The residual toner particles are removed from the surface 15 of belt 14 by a cleaning station 35. As shown, the cleaning station 35 may include a cleaning blade 36 in scrapping contact with the surface 15. The blade 36 is contained within a cleaning housing 48 which has a cleaning seal 50 associated with an upstream opening of the cleaning housing. Alternatively, the toner particles may be mechanically cleaned from the photoconductive surface 15 by a cleaning brush, as is well known in the art.

It is believed that the foregoing general description is sufficient for the purposes of the present application to illustrate the general operation of an automatic xerographic reproduction machine 10 which can embody the fuser apparatus 41 in accordance with the present invention.

Figure 1:
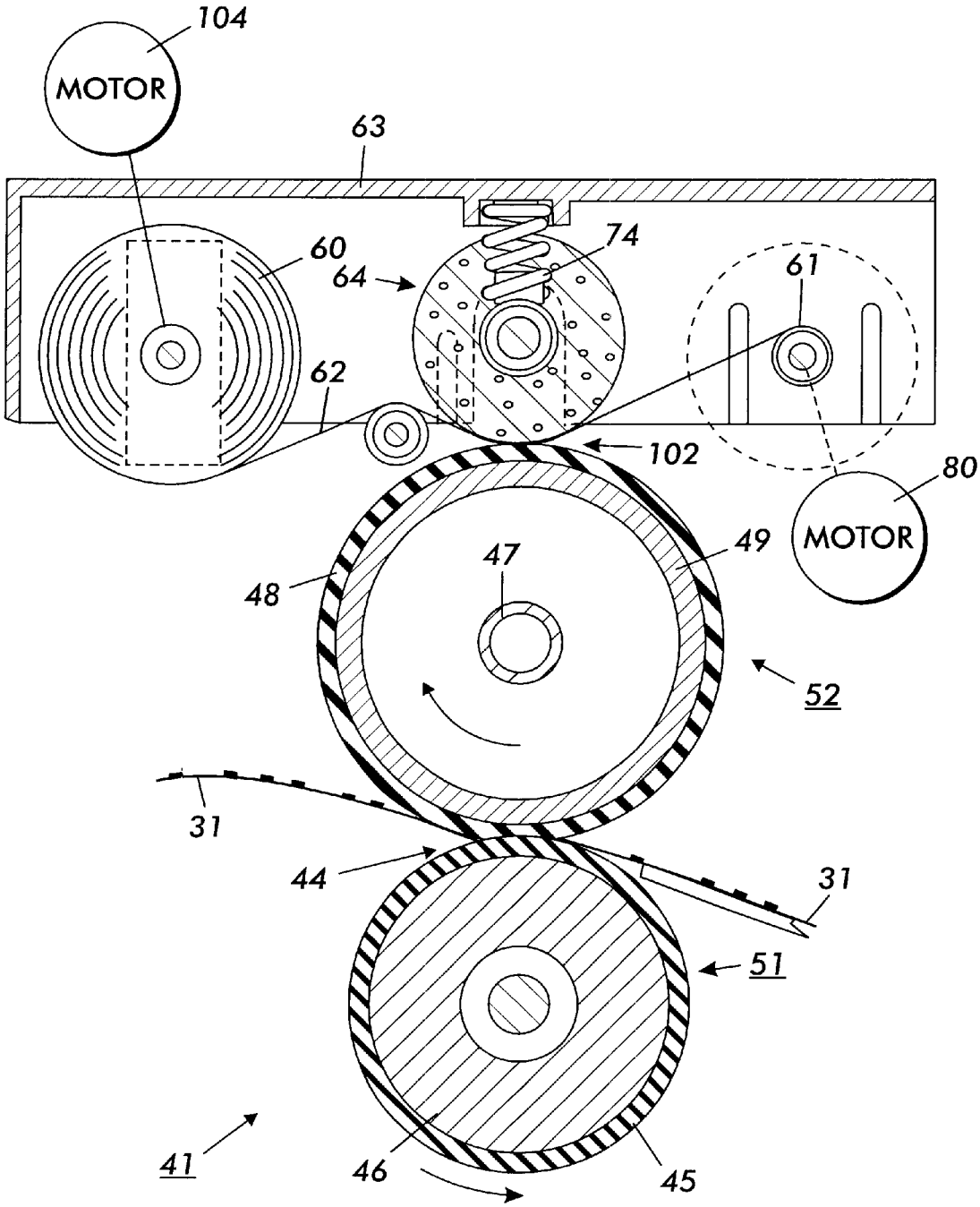
FIG. 1 is a schematic end view of the release agent application system of this invention.

As shown in FIG. 1, the fuser roll 52 is composed of a core 49 having coated thereon a thin layer 48 of an elastomer. The core 49 is hollow and a heating element 47 is generally positioned inside the hollow core to supply the heat for the fusing operation.

The fuser roll 52 is shown in a pressure contact arrangement with a backup or pressure roll 51. The pressure roll 51 comprises a metal core 46 with a layer 45 of a heat-resistant material. In this assembly, both the fuser roll 52 and the pressure roll 51 are mounted on bearings (not shown) which are mechanically biased so that the fuser roll 52 and pressure roll 51 are pressed against each other under sufficient pressure to form a nip in area 44. It is in this nip that the fusing or fixing action takes place.

Figure 2:
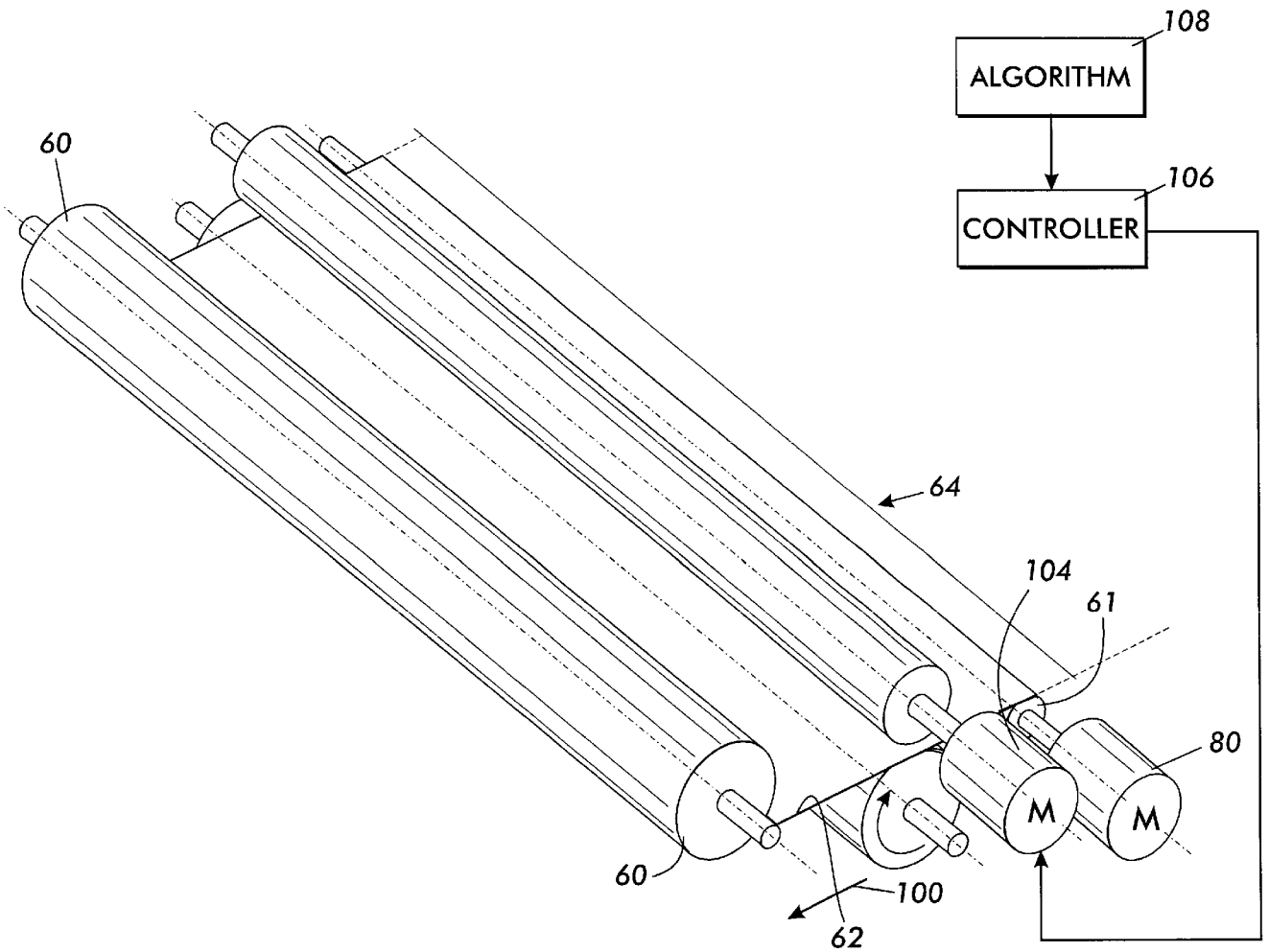
FIG. 2 is a perspective view, from above, of the main elements of the release agent application system of this invention.

As illustrated in FIGS. 1–3, the fuser apparatus 41 includes a release agent management (RAM) system shown generally at 55. The system 55 comprises a housing 63 which may typically be a one-piece plastic molded member having mounting elements such as slots or holes to accommodate the reels and rollers of the system 55. The release agent dispensing apparatus includes an impregnated web 62 which is saturated with a release agent, such as oil, and rolled onto supply reel 60. Take-up reel 61 receives the impregnated web 62 which is wound on reel 61 as the web material is used. An application roller 64 is mounted between the reels 60 and 61 and adjacent to the fuser roll 52 to form a nip in cooperation with the fuser roll 52. The web supply reel 60 and web take-up reel 61 are supported in the housing 63 such that when the system 55 is in place, the supply reel 60 is on one side of the fuser roll 52 and the take-up reel 61 is on the other side. The impregnated web 62 is threaded from the supply reel 60 to the take-up reel 61, through the nip 102 for movement along a path adjacent the fuser roll 52. The application roller 64 is mounted for free rotation in the housing 63 opposite the fuser roll 52. In this position the roller 64 operates as a pinch roll and urges the moving portion of the web 62 into release agent applying engagement with the fuser roll 52.

As shown, the application roller 64 of the present invention is spring biased toward the fuser roll 52 by two coil springs 74 at each end of the roll arrangement (only one of which is shown) to create pressure between the impregnated web 62 and the fuser roll 52. This facilitates delivery of an adequate quantity of release agent to the fuser roll 52. A motor 80 and a suitable drive connection are provided for effecting rotation of the take-up reel 61 for taking up sections of the web 62 from the supply reel 60 as web 62 passes from the nip 102. In the system of this invention, the sole purpose of the take-up drive is to maintain a consistent tension on the web material.

In order to keep track of the supply of web material 62 it is important to maintain a constant speed of the web material 62 as it is dispensed from the supply reel 60 to the take-up reel 61. At a constant speed, a metered length of web material 62 is moved to the take-up reel 61 for each copy processed in the machine. This allows the user to be notified, after a predetermined number of copy cycles, that service is needed, namely to replace the release agent web. In prior art systems the take-up reel 61 was driven and operated to draw the web material 62 through the nip 102. An algorithm was used to calculate a theoretical instantaneous diameter from which the desired speed could be determined for the purpose of controlling the drive motor for the take-up reel 61. This has been found to be problematical since the angular velocity of the reel will change due to the changing diameter of the reel 61. In prior art systems, the take-up reel 61 was the driven element and therefore the determining factor in the monitoring of the supply of web material. This proved somewhat inaccurate because, as the web material 62 was wound onto take-up reel 61, it was subject to wrinkling, stretching, and contamination. All of these factors caused the diameter of the take-up reel to increase in an uncontrolled manner, thereby increasing the dispensing speed of the web material 62 and causing a premature exhaustion of the web material 62. This generally resulted in a failure of the fuser roll 52.

To avoid this problem, in accordance with this invention the take-up reel 61 is no longer the controlling element. The supply reel 60 is driven by a motor 104 which results in a more consistently maintained web speed. Motor 104 is governed by a controller 106 in accordance with an algorithm 108 which is calculated to adjust the angular speed of the motor 104 to compensate for the changing diameter of supply reel 60. A more predictable speed results. This is because the material, as it is drawn from the supply reel 60, is not subject to the operational difficulties which caused the prior inaccuracies. Motor 104 is connected to supply reel 60 through an appropriate drive connection, as shown in FIGS. 1 and 2. In the system 55 according to this invention, the feeding of the web material 62 through the nip 102 is accomplished having a direction of movement consistent with the tangential movement of the surface of fuser roll 52. This facilitates the use of a supply reel 60 which is driven.

Any suitable web material capable of withstanding fusing temperatures of the order of 225° C. may be employed. Typically, the web material 62 is capable of being impregnated with at least 25 grams per meter square of liquid release agent such as silicone oil. The web material may be woven or non-woven and of a sufficient thickness to provide a minimum amount of release agent for a desired life.

Referring in particular to FIG. 2, a copy sheet 31 (FIG. 1) is fed along a path indicated by the arrow 100. The engagement of copy sheet 31 with the fuser roll 52 tends to extract a certain amount of the release agent deposited on the fuser roll 52. To avoid depletion of the release agent, there must be a replenishment of the supply within the release agent management system 55. The application roller 64 may be used to supply additional amounts of release agent to the web 62.

It is, therefore, apparent that there has been provided in accordance with the present invention, a fuser apparatus having a release agent application system. The supply reel for the impregnated web material is driven to accomplish the aims and advantages set forth above. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A printing machine in which a print medium receives an electrostatic image comprising:

an electrostatic applicator for applying an image to a print medium;

a fuser roll mounted for rotation in the printing machine for applying heat to the print medium to bond said electrostatic image to the print medium;

apparatus to apply a release agent to the fuser roll further comprising:

a web material impregnated with said release agent wound in a roll on a supply reel, said supply reel being mounted for rotation adjacent to said fuser roll;

a drive mechanism for rotating said supply reel to dispense said web material towards said fuser roll;

a take-up reel positioned to receive the web material after it is extended across said fuser roll for engagement therewith; and an application roller mounted for rotation between said supply reel and said take-up reel adjacent to said fuser roll, said application roller forming a nip with said fuser roll through which the web material extends, said nip providing a release agent applying engagement of said web material with said fuser roll.

2. A printing machine in which a print medium receives an electrostatic image, as described in claim 1, wherein said drive mechanism is an electric motor and further comprising:

a processor control connected to said electric motor to cause said electric motor to rotate at an angular velocity which varies in accordance with the changing diameter of said roll of web material to provide a consistent speed of said web material through said nip.

3. A printing machine in which a print medium receives an electrostatic image, as described in claim 1, wherein said web material is dispensed through said nip in a direction consistent with the direction of rotation of said fuser roll.

4. A printing machine in which a print medium receives an electrostatic image, as described in claim 1, wherein said take-up reel is driven to maintain a tension on the web material as it is dispensed through said nip.

5. Apparatus constructed to apply a release agent to a fuser roll of an electrostatic printing machine comprising:

a web material impregnated with said release agent wound in a roll on a supply reel, said supply reel being mounted for rotation adjacent to said fuser roll;

a drive mechanism for rotating said supply reel to dispense said web material towards said fuser roll;

a take-up reel positioned to receive the web material after it is extended across said fuser roll for engagement therewith; and an application roller mounted for rotation between said supply reel and said take-up reel adjacent to said fuser roll, said application roller forming a nip with said fuser roll through which the web material extends, said nip providing a release agent applying engagement of said web material with said fuser roll.

6. Apparatus constructed to apply a release agent to a fuser roll of an electrostatic printing machine, as described in claim 5, wherein said drive mechanism is an electric motor and further comprising:

a processor control connected to said electric motor to cause said electric motor to rotate at an angular velocity which varies in accordance with the changing diameter of said roll of web material to provide a consistent speed of said web material through said nip.

7. Apparatus constructed to apply a release agent to a fuser roll of an electrostatic printing machine, as described in claim 5, wherein said web material is dispensed through said nip in a direction consistent with the direction of rotation of said fuser roll.

8. Apparatus constructed to apply a release agent to a fuser roll of an electrostatic printing machine, as described in claim 5, wherein said take-up reel is driven to maintain a tension on the web material as it is dispensed through said nip.

* * * * *